US005287714A

United States Patent [19]

Figge et al.

[11] Patent Number: 5,287,714

[45] Date of Patent: * Feb. 22, 1994

[54] ROLL STAND FOR A PLANETARY ROLLING MILL

[75] Inventors: Dieter Figge; Peter Fink, both of Essen, Fed. Rep. of Germany

[73] Assignee: Mannesmann Aktiengesellschaft, Dusseldorf, Fed. Rep. of Germany

[ * ] Notice: The portion of the term of this patent subsequent to Jul. 30, 2008 has been disclaimed.

[21] Appl. No.: 805,109

[22] Filed: Dec. 11, 1991

[30] Foreign Application Priority Data

Dec. 20, 1990 [DE] Fed. Rep. of Germany ..... 4041367

[51] Int. Cl.[5] ..... B21B 13/20

[52] U.S. Cl. ..... 72/190; 72/239

[58] Field of Search ..... 72/190, 238, 239

[56] References Cited

U.S. PATENT DOCUMENTS 494,904 4/1893 Story ..... 72/238

3,318,130 5/1967 Sendzimir ..... 72/238

4,136,545 1/1979 Wilson ..... 72/238

5,035,131 7/1991 Fink et al. ..... 72/238

*Primary Examiner*—John Sipos

*Assistant Examiner*—Thomas C. Schoeffler

*Attorney, Agent, or Firm*—Cohen, Pontani, Lieberman, Pavane

[57] ABSTRACT

A roll stand for a planetary rolling mill having a housing, and two stationary support members mounted in chocks, with rolling segments and intermediate and work rolls mounted in rotationally driven cages. The support members have a plurality of rolling segments, spaced about an outer surface thereof. By the turning of the support members, the rolling segments can be brought, in each case, into working position. In order to be able to effect a change of the rolling segments while using the favorable torque division of the drive system for the roll cages, the support members (1) are rotatably mounted in their chocks (15) adapted to be clamped (20) in the working position of the rolling segments (16). A drive is selectably engaged to rotate the support member into a new working position.

9 Claims, 5 Drawing Sheets

ROLL STAND FOR A PLANETARY ROLLING MILL

FIELD OF THE INVENTION

The present invention relates to a roll stand for a planetary mill having a housing, two stationary support members mounted in chocks with interchangeable rolling segments, and intermediate and work rolls mounted in rotationally driven cages and revolving around the support members, with a plurality of rolling segments for supporting the intermediate and work rolls, being distributed uniformly over the circumference of the support members and being adapted to be brought into working position by turning the support members through angles corresponding to the arrangement of the rolling segments. When a rolling segment at the shaping zone is worn or is otherwise to be replaced or changed, the support body is rotated so that a different rolling segment is at the shaping zone.

BACKGROUND OF THE INVENTION

A roll stand having features in common with the present invention is described in U.S. Pat. No. 5,035,131 not constitute a prior publication. U.S. Pat. No. 5,035,131, in the same way as the present application, is based on the problem of compensating for the relatively short working life of the rolling segments, which are subjected to very heavy mechanical loads during operation, by minimizing the shutdown times required for the replacement of the rolling segments. In the prior art, this replacement is effected by arranging a plurality, preferably four or eight rolling segments, in the support member. If the rolling segment is worn, a new rolling segment can be brought into working position by the turning of the entire support member, after it has been removed to a position outside of the stand. This requires loosening the strips which guide the chocks, which support the support member in the housing, and handling the structural unit consisting of rolls and support member by means of a crane or the like, which necessarily presupposes the shutting down of the mill.

U.S. Pat. No. 5,035,131 discloses four rolling segments distributed symmetrically over the circumference of the support body of the rolling mill. In that mill, the chocks, the support body and cages holding the two sets of intermediate and work rolls must be removed from the roll stand after the end of the useful life of a rolling segment has been reached, for instance, after about 25 hours. The assembly is turned 90° and reinstalled into the stand. This operation disadvantageously requires the shutting down of production.

In certain instances, rolling mills of the above mentioned type in which the useful life of the rolling segments is less than 25 hours. Such cases occur, for instance, upon the rolling of alloy steels having high resistance to deformation, or else upon the rolling of structural steels at low rolling temperatures, in which connection high reshaping resistances also result. If the rolling forces are, for instance, twice as great in this case, this means a reduction of the useful life of the rolling segments by a factor of eight.

To transport the sets of rolls out of the stand after about three hours in order to change the rolling segments, means an unacceptable interruption of production of at least about 30 to 40 minutes. Furthermore, there is the disadvantage that each set of heavy rolls can be turned only with difficulty and by means of heavy devices. For the depositing of the individual sets of rolls, a free space is required and the handling of the set of rolls ties up a heavy crane.

SUMMARY OF THE INVENTION

The problems and disadvantages described above led the present inventors to devise a method and apparatus which may be more advantageous in certain applications, wherein the different rolling segments are brought into rolling action sequentially one after the other, without removing the set or sets of rolls from the stand.

The present invention enables, in simple fashion, the replacement of worn rolling segments by rotating the support body by the same drive means as is present for driving the roll cages or to adjust for different sections of rolled strip by turning to differently shaped rolling segments. The simple turning of the support body requires a less frequent removal of the rolling segments and thus considerably reduces the standstill or plant shutdown times, while the possibility of being able to chose the most suitably shaped rolling segment, if a variety of shapes are present, permits the influence or control of the profile of the rolled material with very simple means in a short amount of time.

According to German Patent Application DE P 40 35 275.7, and U.S. patent application Ser. No. 07/785,867 filed Oct. 29, 1991 and incorporated herein by reference, several rolling segments may be arranged in a turret head-like holder which is rotatably supported in a corresponding cutout in the support member. This solution has the advantage that the turning of the turret head, and thus a change of the active rolling segments, can be effected in the installed condition of the support member. The drive for the cages directly drives the rotational repositioning of the support member, and is of very large size, since a torque reduction via the use of several intermediate gears is not possible.

It is more preferable according to the present invention that the drive solution consist of a pinion shaft, passing centrally through the support member, which engages intermediate gears which further engage an inner toothing of the cages, and also selectively engages the support member. Such a torque division of a rotary drive permits the division of the large cage torques by a simple, compact and reliable mechanism.

The present invention therefore allows a change of the rolling segments while the roll sets are installed in the housing, without having to abandon the favorable torque division of the drive system.

In order to achieve this object, it is proposed, in accordance with the present invention, that the support members be rotatably mounted in their chocks and clamped in the corresponding working position of the rolling segments. It is thus possible, in contrast to the prior art, to provide any desired number of rolling segments corresponding to the space available on the support member and to bring them into working position by turning the support member in the chocks. These segments are preferably evenly spaced about the circumference of the support members.

The prior art requires the changing of the entire roll set, presupposing chocks having a prismatic shape with parallel resting surfaces. The rolling mill in accordance with the present invention ensures that the turnable support member can be turned into the correct angular position and clamped in that position without removing the roll set from the mill. This is affected by mounting of the cages on the support member and arranging the intermediate gears for the driving of the cages preferably in a "built-up" support member, with reference in particular also to simple assembly. In this regard, special structural measures are necessary, which are particularly important in the case of a large machine. A preferred embodiment of the present invention has a cage diameter of about 2.8 meters.

One particular advantage of the present invention results from the fact that the rotary drive of the cages, which must otherwise be present for operation of the mill, is also used for turning the support members. In the present invention, the rotary drive for the cages for the intermediate and work rolls are adapted to be coupled to and uncoupled from the support member for rotating the support member, to operatively engage a new working surface thereon.

In this connection, it is provided that the pinion shaft which passes centrally through the support member for the driving of the cages, have mounted on the end thereof, extending out of the support member, a coupling member which can be coupled to and uncoupled from a second coupling member which is operatively connected to the support member, for selective rotation thereof.

An additional turning drive for the support members is, therefore, unnecessary. In accordance with a preferred aspect of the present invention, an angle step producer for producing or controlling the angle of rotation of the support member is arranged between the chock and the support member.

The accurate positioning of the support members, and thus of the rolling segments, is no longer effected, as in the prior art, via the prismatically shaped chocks. In accordance with another feature of the present invention, in order to determine the exact position of the rotated support member, a conical pin is provided on a flange of the support member, which pin can be engaged by axial displacement into corresponding holes in the chock.

In order to use the advantageous drive with torque division for the planetary mill and, nevertheless, permit an easy assembly and disassembly of the mill, in accordance with another feature of the invention, the support members consist of a base body having detachable end pieces arranged axially in force-locked manner on both sides, i.e., end pieces which maintain their position by way of pressure applied on the end pieces against the base body.

The end pieces surround the pinions for the cage drives and also support the cage bearings. Since the force-locked and angularly precise connection of the end pieces to the support member is particularly important for reliable conveying the moments of flexure from the support member into the chocks, a so-called SKF hydraulic oil connection is employed for the force-locked friction connection of the large parts (support member and end pieces). The exact angular position is secured by a plurality of transverse wedges. Furthermore, the connection is held under axial tension by necked-down bolts. The end pieces are partially milled out in order to mount three intermediate gears for the torque division of the drive system. The torque is transmitted from the pinion shafts to the hollow gears of the cages via the intermediate gears.

The drive system for the present invention is conventional and not part of the present invention, so that further details thereof are not necessary herein, and details are known.

BRIEF DESCRIPTION OF THE DRAWINGS

The invention is shown by way of the drawings in the Figures, in which.

DETAILED DESCRIPTION OF THE PREFERRED EMBODIMENTS

Figure 1:
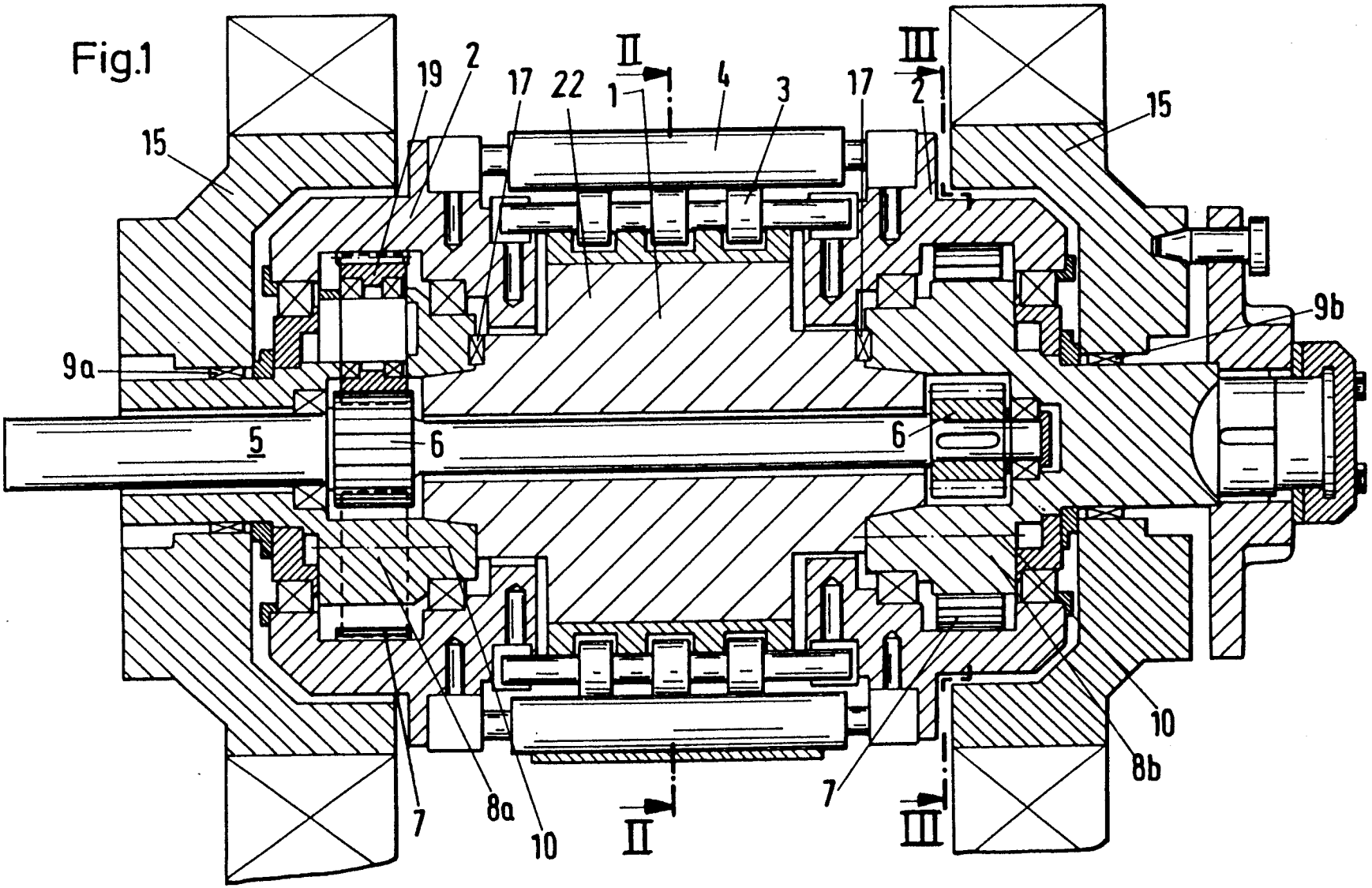
FIG. 1 shows the upper half of the roll stand of the present invention in a longitudinal section through the support member.
Figure 3:
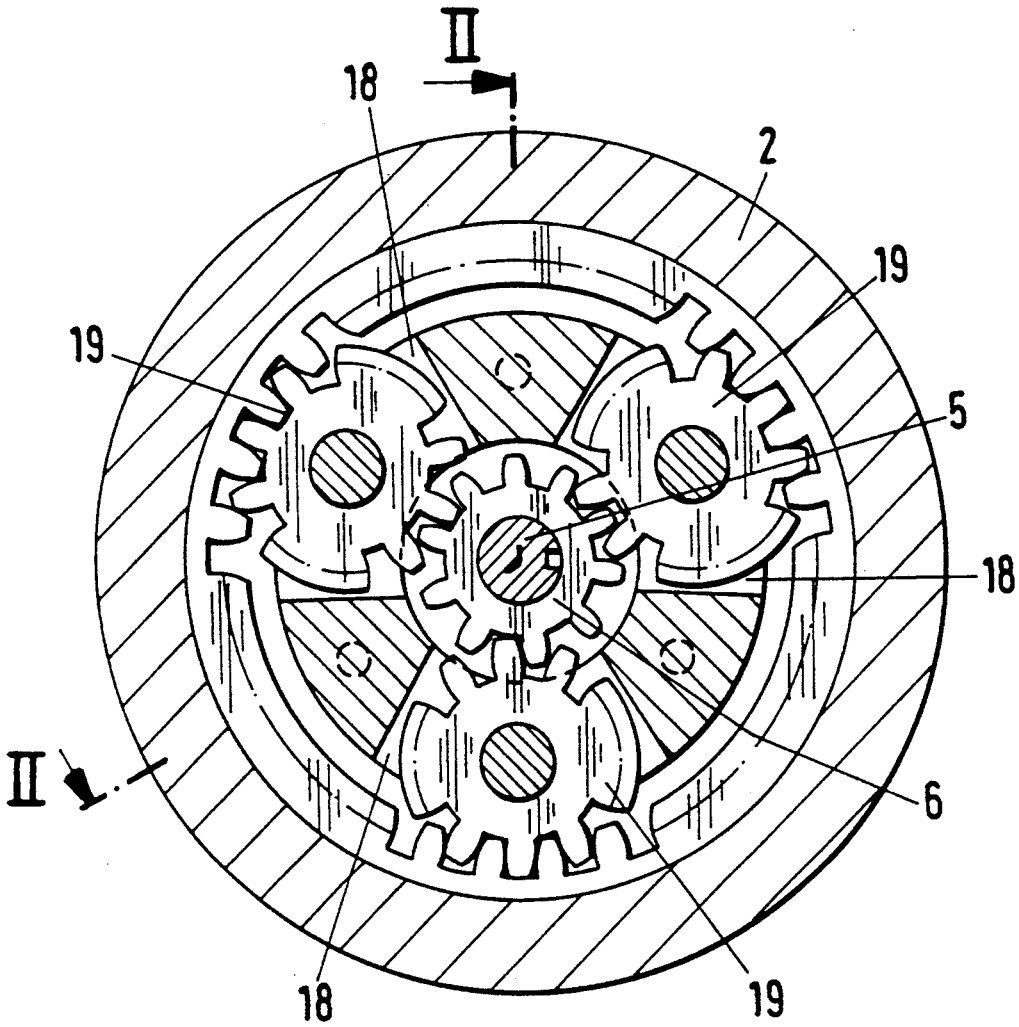
FIG. 3 is a cross section through the support member of the present invention along III—III.

Referring to FIG. 1, the support member 1 has intermediate rolls 3 and work rolls 4, which are mounted in cages 2, to rotate around it. The drive of the cages 2 is effected by the pinion shaft 5 with the pinions 6 via intermediate gears 19, as shown in FIG. 3, to the inner teeth 7 of the cages 2.

The support member 1 is formed of a base member 22 and end pieces, 8*a* and 8*b*. End pieces 8*a*, 8*b* are firmly connected by the pressure applied by an hydraulic oil connection and tightened necked-down bolts 10 to the support member 1, and form a force-locked structure. In addition, the exact angular position of the end pieces 8*a*, 8*b* with respect to the base member 22 is fixed by a plurality of transverse wedges 17.

The support member is mounted in the chocks 15 on bearings 9*a*, 9*b*.

The pinions 6 of the pinion shaft 5 are arranged in the central cylindrical holes in the end pieces 8*a*, 8*b*. The end pieces 8*a*, 8*b* each have on their periphery three cutouts 18, within which the intermediate gears 19 between pinion 6 and the inner teeth 7 of cage 2 are arranged (see FIG. 3).

Figure 2:
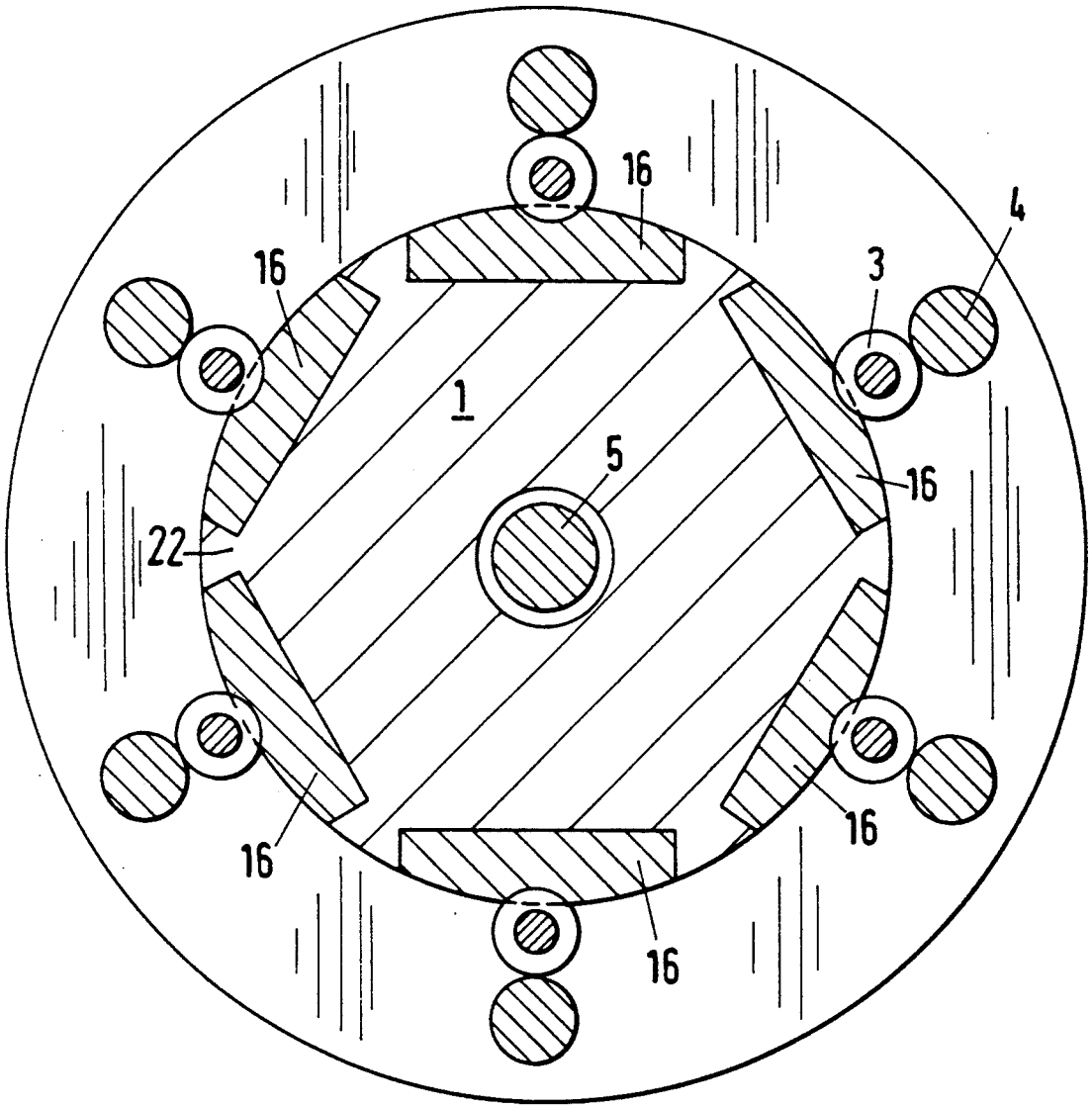
FIG. 2 is a cross section through the support member of the present invention along the section line II—II.

As can be noted from FIG. 2, the pinion shaft 5 travels in a central cylindrical hole in the support member 1. The support member 1 can thus be fabricated symmetrically and with high flexural stiffness. In the embodiment shown, 6 rolling segments 16 are arranged on the support member 1, and can be brought optionally into working position by turning the support member 1 by 60°. Otherwise identical parts bear the same numbers. It should, of course, be realized that any number of rolling segments may be formed on the support member, having argitrary spacing, so long as a desired rotation can effectively and accurately present an unworn working surface to the part of the support member which acts as the rolling segment.

FIG. 3 is a cross section through the support member in the region of the intermediate gears 19 and shows the cutouts 18 in the end pieces 8*a*, 8*b*.

Figure 4:
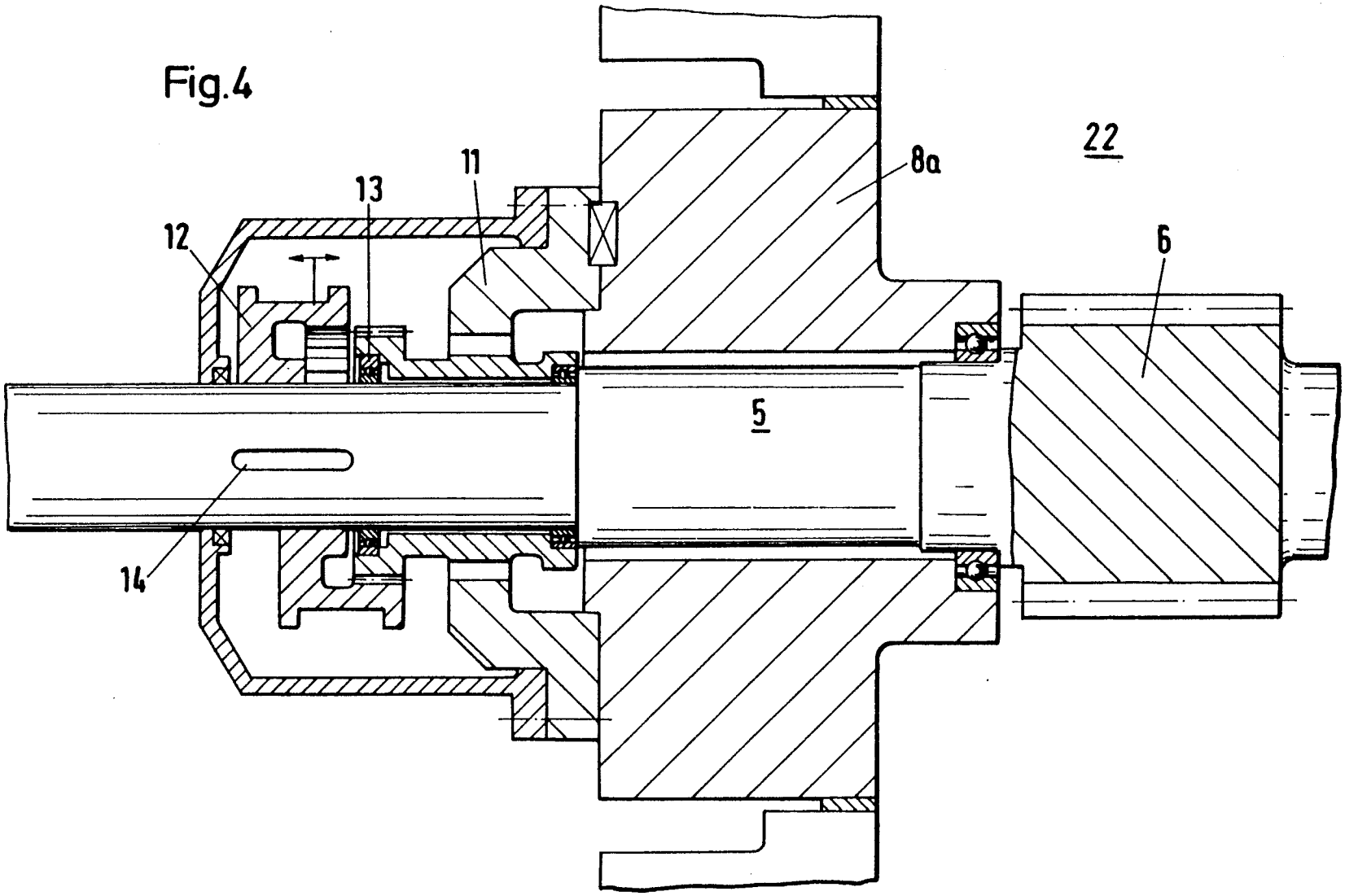
FIG. 4 shows the coupling for the connecting of the pinion drive shaft to the support member of the present invention.

FIG. 4 shows the coupling by which the pinion shaft 5 can be coupled to the support member 1. In front of the support member 1, the left end piece 8*a* is diagrammatically indicated here, said end piece, as stated above, being connected in force-locked manner to the base member 22 of the support member 1. On the pinion shaft 5, there is mounted a gear coupling connection part 11 which is connected at 12 to the end piece 8*a*. The rotary bearing 13 permits the free rotation of the pinion shaft 5 with the coupling connection part 11 fixed.

The second gear coupling connection part 12 is fastened at location 14, fixed by wedge connection, on the pinion shaft 5, the coupling connection part 12 turning together with the rotating pinion shaft 5 and being adapted to be brought into operative connection, by displacement from a resting position, with the coupling connection part 11, as shown in the lower half of FIG. 4.

In this connected position, a slow rotation of the pinion shaft 5 via the coupling connection parts 11, 12 effects a turning of the support member 1 into the desired position of rotation.

After the loosening of the coupling connection parts 11, 12, the pinion shaft 5 again serves, via the pinion 6, for the driving of the cages 2 for the intermediate rolls 3 and work rolls 4.

Figure 5:
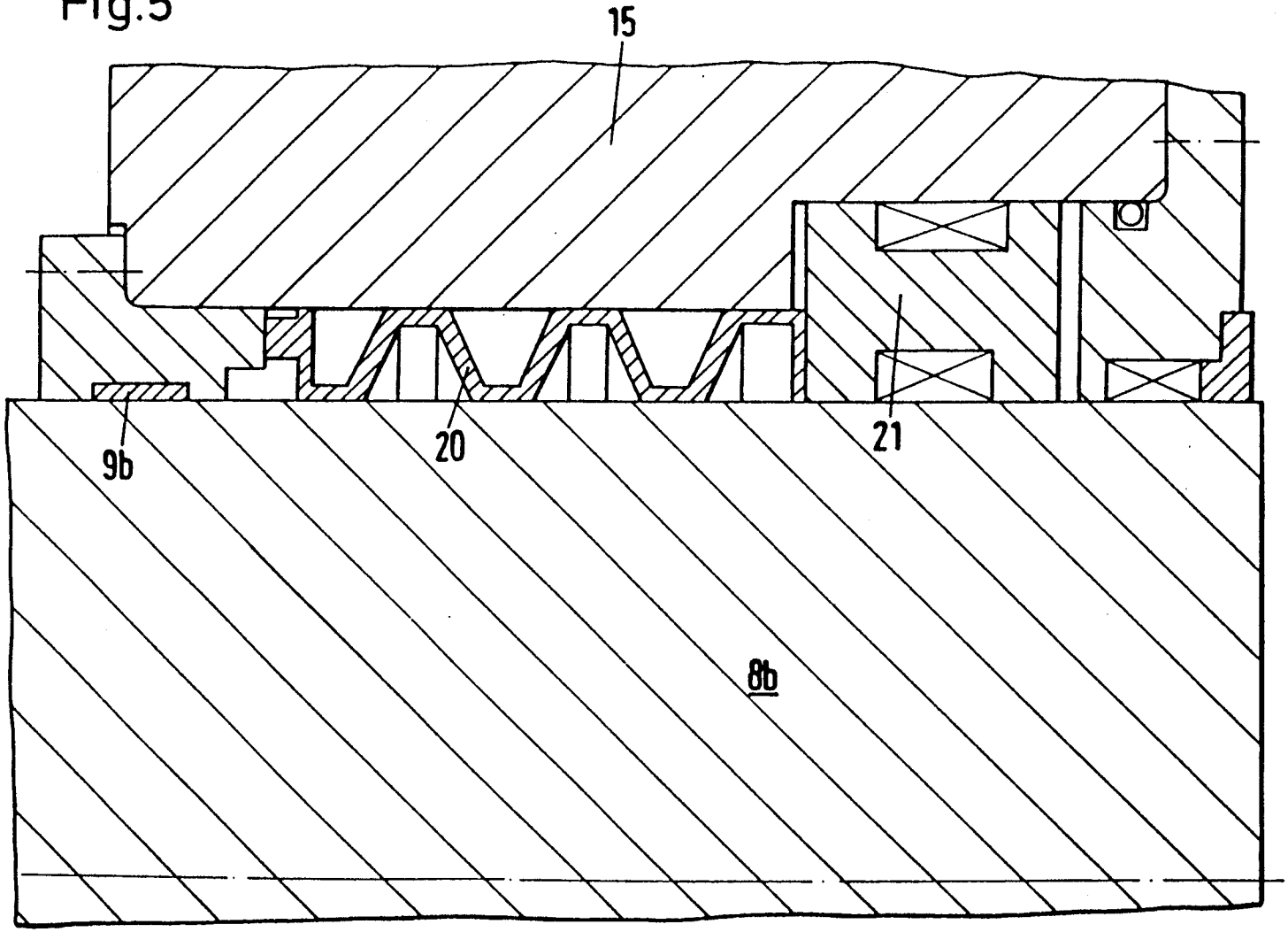
FIG. 5 shows the clamp between support member and chock of the present invention.

FIG. 5 shows the development of the clamping of the support member 1 by means of a Spieth sleeve, designated 20. The meander-shaped (non-circular) Spieth sleeve is acted on by an axial force applied by the annular piston 21 and, in this connection, exerts radial forces between support member 1 and chock 10. The radial forces lead to a force-lock between the two parts forming a coupling therebetween.

Thus, while there have been shown, described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, however, therefore, to be limited only as indicated by the scope of the claims appended hereto.

What is claimed is:

1. A roll stand for a planetary rolling mill comprising a housing, two stationary support members mounted in chocks with a plurality of rolling segments being distributed over a circumference of said support members and intermediate and working rolls mounted in rotationally driven cages and revolving around said support members, each of said support members being rotatably mounted in said chocks for bringing one of said rolling segments into a working position by rotation of said support member, and means for clamping said support members in said working position of one of said plurality of rolling segments after being rotated.

2. The roll stand according to claim 1, further comprising a rotary drive for said cages for said intermediate and work rolls, for rotating said support members, and means for coupling said rotary drive to said support member and for uncoupling said rotary drive from said support member.

3. The roll stand according to claim 1, further comprising a pinion shaft which passes through a central axis of said support member, for driving of said cages, having a first connection coupling part configured for selectable engagement with a second connection coupling part which is rotationally linked to said support member at an end of said pinion shaft extending out of said support member.

4. The roll stand according to claim 1, wherein said rolling segments are distributed uniformly over said circumference of the support members, and said support member is rotated through an angle corresponding to an angular displacement of said plurality of rolling segments, further comprising means for detecting an angle of rotation of said support member, with respect to said chock.

5. The roll stand according to claim 4, wherein said angle detecting means comprises an angle-step producer.

6. The roll stand according to claim 1, wherein said support member comprises a conical pin which is provided on a flange of said support member, said pin being adapted to engage a corresponding means of said chock by axial displacement of said pin, so that the rotation of the support body may be accurately determined.

7. The roll stand according to claim 1, wherein said support member comprises a generally cylindrical base member and detachable end pieces arranged coaxially on both sides of said base member, having intermediate gears for transmitting a rotational torque from a shaft to said cage and from said shaft to said support body, being arranged in at least one of said end pieces.

8. The roll stand according to claim 7, further comprising hydraulic pressure actuators and bolts for connecting said end pieces to said support member and a transverse wedge for maintaining a precise angular position of one of said end pieces with respect to said base member.

9. The roll stand according to claim 1, further comprising a hydraulically actuatable Spieth sleeve between said support member and said chock for rotationally clamping said support member with respect to said chock.

* * * * *